US008781376B2

(12) United States Patent
Ichikawa

(10) Patent No.: US 8,781,376 B2
(45) Date of Patent: Jul. 15, 2014

(54) TONER SUPPLY DEVICE AND IMAGE FORMING APPARATUS

(75) Inventor: Yoshiki Ichikawa, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 93 days.

(21) Appl. No.: 13/552,184

(22) Filed: Jul. 18, 2012

(65) Prior Publication Data

US 2013/0022374 A1 Jan. 24, 2013

(30) Foreign Application Priority Data

Jul. 21, 2011 (JP) ..... P2011-160370

(51) Int. Cl.
*G03G 15/08* (2006.01)

(52) U.S. Cl.
CPC ..... *G03G 15/0836* (2013.01); *G03G 15/087* (2013.01); *G03G 2215/0663* (2013.01)
USPC ..... 399/263

(58) Field of Classification Search
CPC ..... G03G 15/0836; G03G 15/087; G03G 2215/0663
USPC ..... 399/262, 263
See application file for complete search history.

(56) References Cited

U.S. PATENT DOCUMENTS

| | | | | |
|---|---|---|---|---|
| 5,774,772 | A * | 6/1998 | Kai et al. | 399/260 |
| 2008/0298846 | A1* | 12/2008 | Ohgoshi et al. | 399/263 |
| 2009/0208253 | A1 | 8/2009 | Ohgoshi et al. | |
| 2010/0310278 | A1* | 12/2010 | Naoi et al. | 399/263 |

FOREIGN PATENT DOCUMENTS

| | | | | |
|---|---|---|---|---|
| CN | 101510063 | A | 8/2009 | |
| JP | 02-110481 | | 4/1990 | |
| JP | 07168432 | A * | 7/1995 | G03G 15/08 |
| JP | 9-34233 | | 2/1997 | |
| JP | 2000-147887 | | 5/2000 | |
| JP | 2004-151634 | | 5/2004 | |
| JP | 2009-192958 | | 8/2009 | |

* cited by examiner

*Primary Examiner* — Benjamin Schmitt
(74) *Attorney, Agent, or Firm* — Nixon & Vanderhye P.C.

(57) ABSTRACT

A rotary-type toner supply device includes a toner container and a scraping member. The toner container has a peripheral wall section which is shaped so as to surround a side face of an imaginary column $K_1$ along the side face and has a toner discharge port formed therein, and contains toner in space surrounded by the peripheral wall. The scraping member is contained in the space so as to freely rotate around a central axis S of the imaginary column $K_1$, and has first and second curved parts, each of the first and second curved parts extending along a portion of a half cycle or more of a spiral on the side face of the imaginary column $K_1$.

6 Claims, 8 Drawing Sheets

TONER SUPPLY DEVICE AND IMAGE FORMING APPARATUS

CROSS-REFERENCE TO RELATED APPLICATION

This application claims priority to Japanese Patent Application No. 2011-160370, which was filed on Jul. 21, 2011, the contents of which are incorporated herein by reference in its entirety.

BACKGROUND OF THE TECHNOLOGY

1. Field of the Technology

The present technology relates to a toner supply device and an image forming apparatus.

2. Description of the Related Art

An image forming apparatus equipped with a printer, a multifunction peripheral and the like forms an image using toner reserved in a developing device included in the image forming apparatus. There has been known a toner supply device which supplies toner to the developing device in a field of such an image forming apparatus. When toner in the developing device is consumed and reduced, the toner supply device supplies toner in a toner container included in the toner supply device to a toner hopper connected to the developing device, and the toner hopper supplies the supplied toner to the developing device sequentially.

Recently, a rotary-type toner supply device which supplies toner by rotating a toner container with a rotary drive source included in an image forming apparatus is the mainstream. In such a rotary-type toner supply device, toner is guided to a toner discharge port of the toner container by a rib in a spiral shape formed on an inner wall of the toner container by rotating the toner container and discharged from the toner discharge port so that the toner is supplied to the toner hopper. In such a rotary-type toner supply device, during image formation operation, the toner container is rotated and the toner in the toner container is thus maintaining high fluidity without being aggregated.

However, when the image formation operation is finished and power of the image forming apparatus is turned off, the rotation of the toner container is stopped and the toner in the toner container starts to aggregate by heat in the image forming apparatus. The longer the time in which the toner container is not rotating is, the more the toner in the toner container aggregates to adhere to an inner wall of the toner container. The toner strongly adhering to the inner wall rotates with the toner container even when the toner container starts to rotate again, so as not to be discharged from the toner container to remain. As a result, most of an unused toner remains in the toner container in some cases.

To cope with such a problem, for example, Japanese Unexamined Patent Publication JP-A 2000-147887 discloses a rotary-type toner supply device provided with a spiral scraping member fixed to an inner wall which rotates so as not to move in order to scrape off toner adhering to the inner wall of the rotary toner supply device.

The scraping member described in JP-A 2000-147887 is fixed, thus not rotating with the toner container, and the toner container and the toner in the toner container move relative to the scraping member. Therefore, when there is a small amount of toner in the toner container, it is possible to scrape off the toner with the scraping member for certain, however, when there is a large amount of toner remaining in the toner container, a load on the toner caused by the scraping member is large, so that the toner becomes deteriorated, which poses a problem. Moreover, there is a possibility that as counteraction to the load on the toner, a heavy load is also imposed on the scraping member so that the scraping member is broken.

SUMMARY OF THE TECHNOLOGY

An object of the technology is to provide a toner supply device and an image forming apparatus, capable of reducing as much as possible toner which remains in a toner container, while suppressing a load imposed on the toner to be lessened.

The technology provides a toner supply device, including:

a toner container having a wall section which is shaped so as to surround a side face of an imaginary column along the side face and has an opening formed therein, the toner container containing toner in space surrounded by the wall section;

a joining section fixed to the toner container, configured to join a rotary drive source which rotates the toner container around an axis of the imaginary column; and a scraping member which is contained in the space so as to freely rotate around the axis of the imaginary column and scrapes off toner adhering to the wall section, the scraping member having a curved section extending along a portion of a half cycle or more of an imaginary spiral along the side face.

The toner container which is fixed to the joining section rotates, when the joining section is joined to the rotary drive source which is outside the toner container, around the axis of the imaginary column surrounded by the toner container, and the toner is discharged from the opening of the toner container. In the toner container, the scraping member is contained with the toner. The scraping member is contained so as to freely rotate around the axis of the imaginary column, and rotates with the toner when there is a large amount of toner remaining in the toner container, in association with the rotation of the toner container, and there is thus not so heavy load imposed on the toner. When a large amount of toner is discharged from the opening so that there is a small amount of toner in the toner container, the scraping member at a gravitationally stable position moves less and becomes to oscillate slightly. Relative to the scraping member with less movement, the toner container rotates around the axis of the imaginary column, and the toner strongly adhering to the wall section facing the side face of the column also rotates, thus a relative speed of the scraping member with the toner adhering to the wall section becomes high. The scraping member collides with the toner adhering to the wall section in a state where the relative speed is high, and the toner which adheres to the wall section to be agglomerated is thus shaved and disintegrated to become fine so that the fluidity thereof is recovered, and is thus easily to be discharged from the toner container.

In this manner, the scraping member which is contained in the toner container so as to freely rotate is able to scrape off the toner adhering to the wall section of the toner container while suppressing the load imposed on the toner to be lessened. Further, the scraping member has the curved section extending so as to follow the portion of a half cycle or more of the spiral on the side face of the column. Therefore, even when the scraping member rotates around the axis of the imaginary column in any way, when there is a large amount of toner remaining in the toner container, a state of located along the wall section of the toner container is maintained and it is possible to scrape off the toner more surely. Therefore, the toner supply device is able to reduce as much as possible the toner which remains in the toner container while suppressing a load imposed on the toner to be lessened.

Further, it is preferable that the curved section includes a first curved part extending along a portion of a half cycle or more and one cycle or less of a first imaginary spiral along the side face, and a second curved part extending along a portion of a half cycle or more and one cycle or less of a second imaginary spiral of which proceeding direction is opposite to that of the first imaginary spiral, along the side face, and the scraping member includes a connecting part which connects the first curved part and the second curved part, extends along a line segment which is parallel to the axis of the imaginary column along the side face, and is opposite to the opening.

The scraping member is composed of the first curved part extending so as to follow a portion of a half cycle or more and one cycle or less of a first spiral on the side face of the column, the second curved part extending so as to follow a portion of a half cycle or more and one cycle or less of a second spiral on the side face of the column, and the connecting part which connects the first curved part and the second curved part. Since the first spiral and the second spiral proceed in opposite directions from each other, in a circumferential direction of the column, a direction toward an end part connected to the connecting part from an end part not connected thereto in the first curved part corresponds with a direction toward an end part connected to the connecting part from an end part not connected thereto in the second curved part. When the toner container rotates in the direction, the toner scraped by the scraping member moves along the first curved part and the second curved part so as to move to the connecting part. The connecting part is opposite to the opening, and the toner moved to the connecting part is thus discharged from the opening. In this manner, the toner is able to be guided to the opening with the scraping member.

Further, it is preferable that the curved section has a circular cross-section perpendicular to a direction in which the axis of the imaginary column extends.

The curved section has a circular cross-section perpendicular to the direction in which the axis of the imaginary column extends. Therefore, when the curved section collides with the toner adhering to the wall section of the toner container, it does not occur that the curved section sticks in a toner agglomerate so as to continue to rotate with the toner. Thus, the scraping member is able to scrape off the toner more surely. Moreover, because of the cross-section in a circular shape, it is possible to suppress accumulation of the toner which does not adhere to the wall section on the scraping member.

Further, it is preferable that the scraping member has specific gravity larger than that of the toner.

The scraping member has specific gravity larger than that of the toner. Therefore, it is possible to disintegrate the toner more finely when the scraping member collides with the toner adhering to the wall section of the toner container. Moreover, a buoyant force generated to the scraping member when there is a large amount of toner remaining in the toner container becomes smaller than a self weight of the scraping member, so that it is possible to maintain a state where the scraping member is along the wall section of the toner container more surely.

Further, it is preferable that each of the first curved part, the second curved part, and the connecting part is configured so that specific gravity becomes 1 to 3.

Further, it is preferable that each of the first curved part, the second curved part, and the connecting part is a member having uniform weight, and specific gravity of each of the first curved part, the second curved part, and the connecting part is set to be larger than specific gravity of the toner.

Further, the technology provides an electrophotographic image forming apparatus comprising:

a developing device; and the toner supply device mentioned above as a toner supply device which supplies toner to the developing device.

The toner supply device is capable of reducing as much as possible toner which remains in the toner container while suppressing a load imposed on the toner, so that it is possible to use the toner without wasting it while it is possible to form a high definition image since there will be less deterioration in the toner supplied to the developing device.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
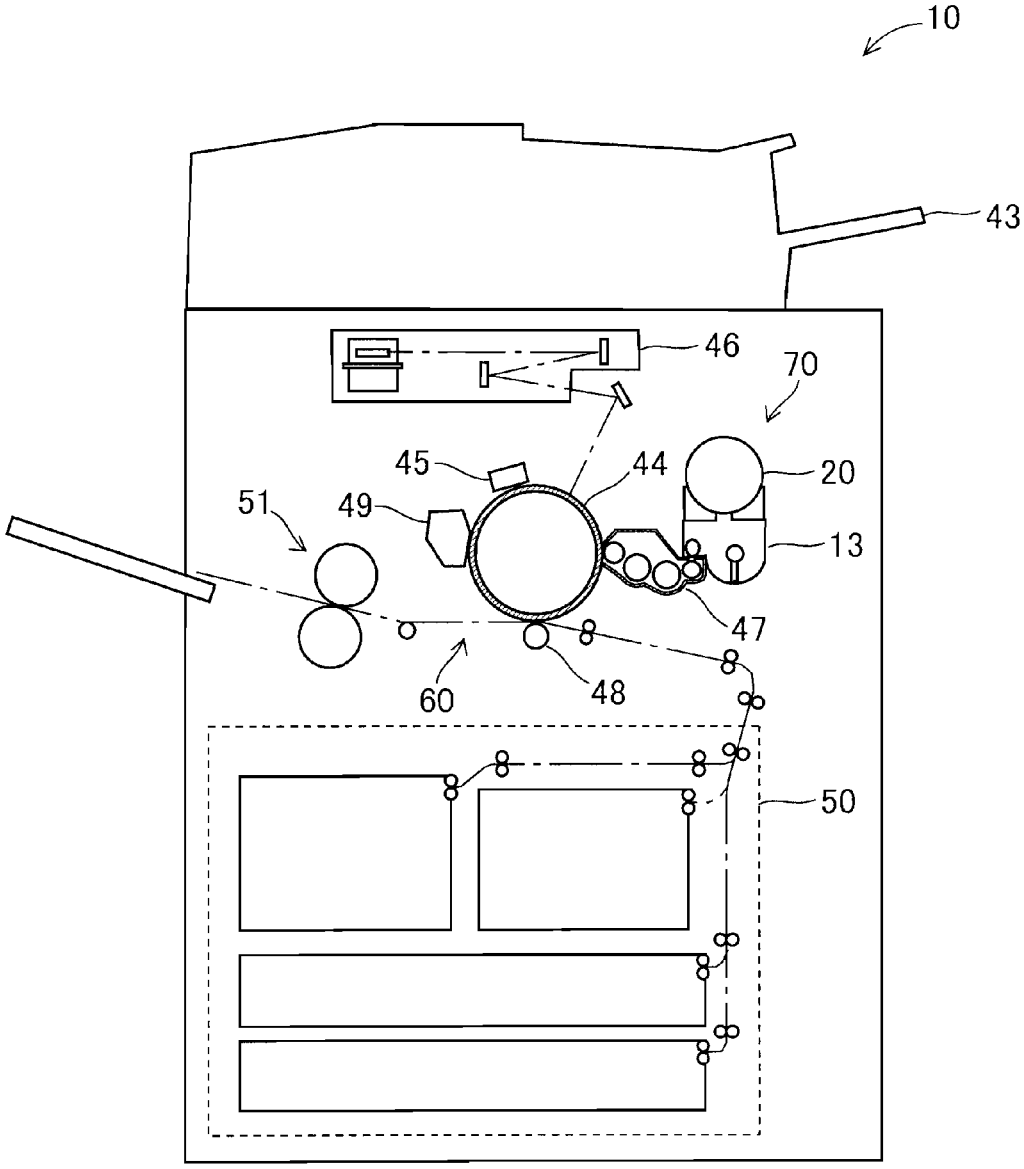
FIG. 1 is a schematic view showing a configuration of an image forming apparatus.

Now referring to the drawings, preferred embodiments are described below.

First, description will be given for an image forming apparatus 10 including a toner supply device 20 according to an embodiment. FIG. 1 is a schematic view showing a configuration of the image forming apparatus 10. The image forming apparatus 10 is an apparatus which forms an image on a surface of a recording medium such as a recording sheet by electrophotography to obtain a printed matter. The image forming apparatus 10 includes a recording medium supply section 50 which supplies a recording medium, a scanner 43 which reads image information from a document or the like, and an electrophotographic process section 60 which forms an image on a supplied recording medium based on the image information read by the scanner or image information inputted from an apparatus which is external to the image forming apparatus 10. The electrophotographic process section 60 includes a photoreceptor drum 44, a charging section 45, an exposure unit 46, a developing unit 70, a transfer section 48, a cleaning section 49 and a fixing unit 51.

The photoreceptor drum 44 includes a conductive substrate in a cylinder shape or a column shape, and a photosensitive layer which is formed on a surface of the conductive substrate, and is provided so as to be rotatable around an axis of the conductive substrate by a rotary drive source (not shown). The conductive substrate is, for example, formed of aluminum. The photosensitive layer is a material which exhibits conductivity by light irradiation, and for which an organic photosensitive layer is used, for example. The organic photosensitive layer may be one in which a charge generation layer including a charge generation substance and a charge transport layer including a charge transport substance are layered, or may be one including the charge generation substance and the charge transport substance are included in one layer.

The charging section 45 is a device which charges the surface of the photoreceptor drum 44 to predetermined polarity and potential. As the charging section 45, a brush-type charger, a roller-type charger, a corona discharger, an iron generator and the like may be used, and in the embodiment, for example, the roller-type charger is used.

Exposure unit 46 is a device which emits laser light. The Light emitted from the exposure unit 46 passes between the charging section 45 and the developing unit 70, and then a surface of the photoreceptor drum 44 is irradiated with the light. The surface of the photoreceptor drum 44 in a charged state is irradiated with the laser light, and thereby, on the surface, an electrostatic latent image corresponding to image information is formed. As the exposure unit 46, for example, a laser scanning unit (LSU) provided with a laser irradiating section and a plurality of reflection mirrors may be used. Additionally, a unit in which an LED (Light Emitting Diode) array, a liquid crystal shutter, and a light source are combined as appropriate may be used as the exposure unit 46.

The developing unit 70 includes the toner supply device 20, a toner hopper 13, and a developing device 47. The toner supply device 20 is arranged vertically above the toner hopper 13 and the developing device 47, and contains unused toner. The toner supply device 20 is a rotary-type toner supply device which is connected to a rotary drive source (not shown) included in the image forming apparatus 10, and supplies the unused toner to the toner hopper 13 when toner in the developing device 47 is consumed to be reduced. The detail of the toner supply device 20 will be described below.

The toner hopper 13 is provided to be adjacent to the developing device 47 vertically below the toner supply device 20. The toner hopper 13 stirs the toner supplied from the toner supply device 20 to be supplied to the developing device 47.

The developing device 47 is a device which develops with toner an electrostatic latent image formed on the photoreceptor drum 44 to form a toner image on the photoreceptor drum 44. The developing device 47 includes a developing tank, a developing roller, a conveying screw and a toner concentration detection sensor. The developing tank contains toner in internal space thereof. In the developing tank, the developing roller and the conveying screw are rotatably supported. In the developing tank, at a position facing the photoreceptor drum 44, an opening is formed, and at a position opposing to the photoreceptor drum 44 having the opening therebetween, a developing roller is provided.

The developing roller is a member which supplies toner to the electrostatic latent image on the surface of the photoreceptor drum 44 at a closest part to the photoreceptor drum 44. While supplying toner, a potential of which polarity is opposite to a charging polarity of the toner is applied to the surface of the developing roller as developing bias voltage (developing bias). Thereby, the toner on the developing roller surface is supplied to the electrostatic latent image smoothly. It is possible to control an amount of toner supplied to the electrostatic latent image (toner adhesive amount) by changing a value of the developing bias.

The conveying screw is a member which supplies toner at the periphery of the developing roller. The toner is stirred and conveyed by the conveying screw, and is supplied to the developing roller in a charged state.

The toner concentration detection sensor is provided at a bottom face of the developing tank. The toner concentration detection sensor detects a toner concentration in the developing tank. As the toner concentration detection sensor, a general toner concentration detection sensor may be used, including, for example, a transmission light detection sensor, a reflection light detection sensor, a magnetic permeability detection sensor and the liked. Among these, the magnetic permeability detection sensor is preferable.

The toner concentration detection sensor is electrically connected to a toner concentration control section. When a toner concentration value by the toner concentration detection sensor is lower than a predetermined set value, the toner concentration control section operates the rotary drive source connected to the toner supply device 20 so that toner in the toner supply device 20 is supplied to the toner hopper 13.

The transfer section 48 is a roller member being in pressure-contact with the surface of the photoreceptor drum 44, and is provided to be rotatable around an axis thereof by a rotary drive source (not shown). A toner image borne and conveyed on the photoreceptor drum 44 is transferred to a recording medium supplied from the recording medium supply section 50 which is described below, in a pressure-contact section between the transfer section 48 and the photoreceptor drum 44.

The cleaning section 49 is a member which removes, after a toner image is transferred to a recording medium from the photoreceptor drum 44, toner which remains on or paper powder adhered during transferring to the surface of the photoreceptor drum 44 to clean the surface of the photoreceptor drum 44. As the cleaning section 49, a plate-like member for scraping off toner and a container-like member for collecting toner scraped off are used.

The recording medium supply section 50 includes a container section for containing a recording medium and a conveying roller which conveys a recording medium. The recording medium contained in the containing section is fed to the pressure-contact section between the photoreceptor drum 44 and the transfer section 48 by the conveying roller, and after the toner image is transferred, fed to the fixing unit 51. As the recording medium, plain paper, color copy paper, a sheet for an overhead projector, a post card and the like are included.

The fixing unit 51 includes a heating roller and a pressure roller. The heating roller is controlled to be a predetermined fixed temperature. The pressure roller is a roller which is in pressure-contact with the heating roller. The heating roller holds the recording medium with the pressure roller while applying heat thereto, so that toner constituting a toner image is melted to be fixed onto the recording medium. The recording medium to which the toner image is fixed is conveyed to the outside of the image forming apparatus 10, and image formation operation is completed.

Figure 2:
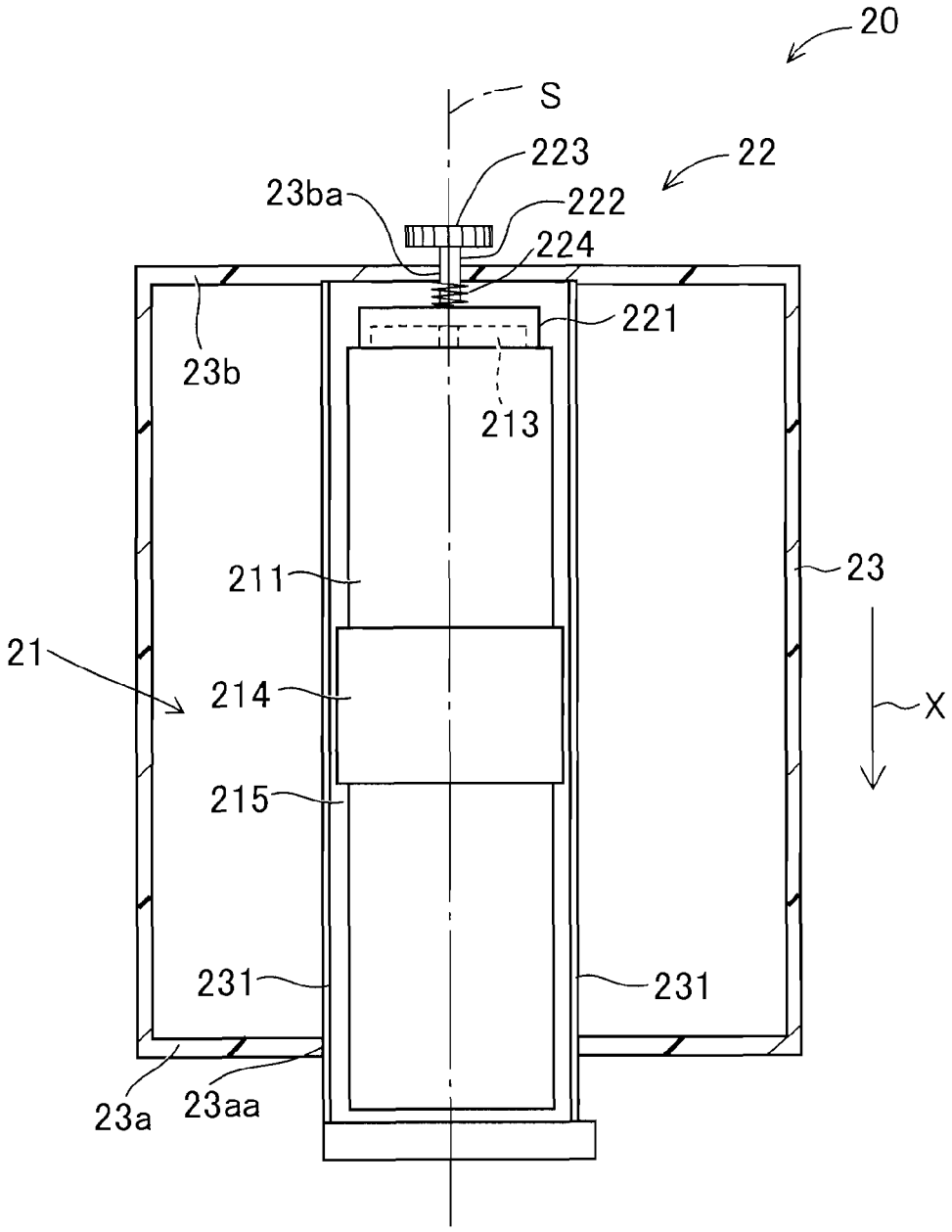
FIG. 2 is a view showing a configuration of a toner supply device.
Figure 3:
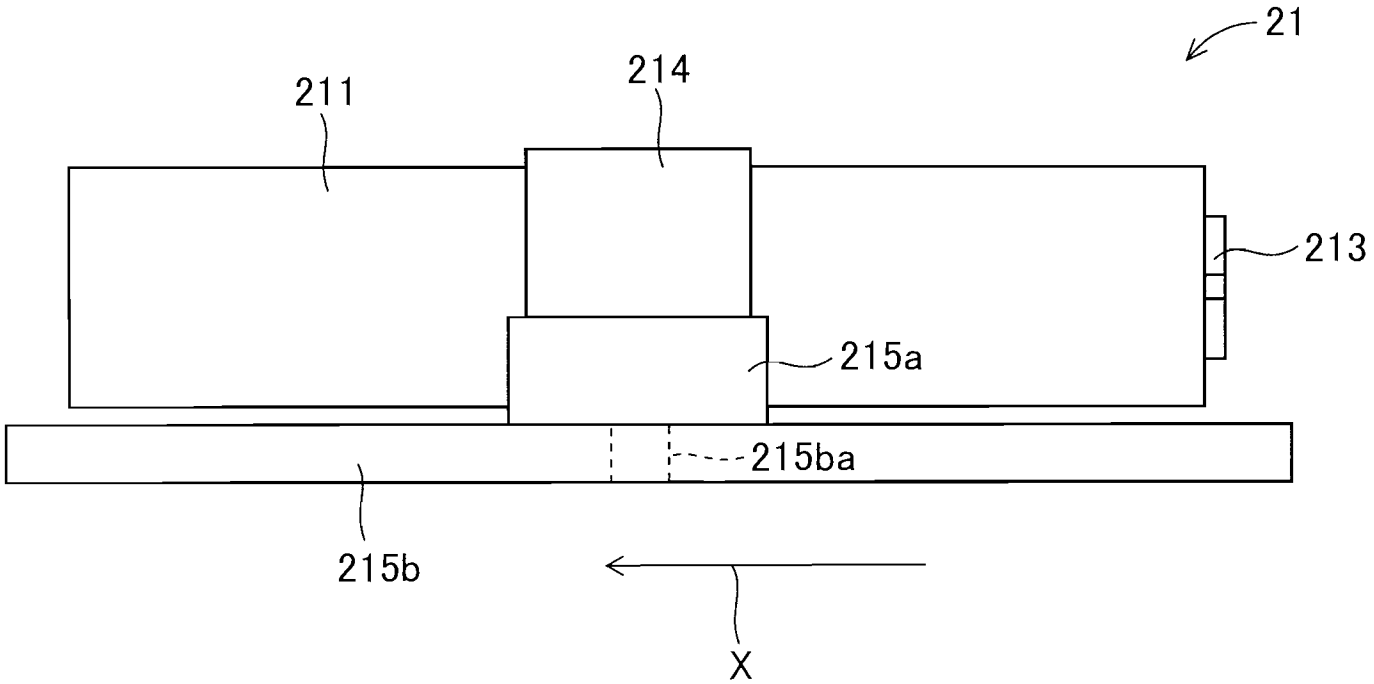
FIG. 3 is a side view of a supply device body section included in the toner supply device.
Figure 4:
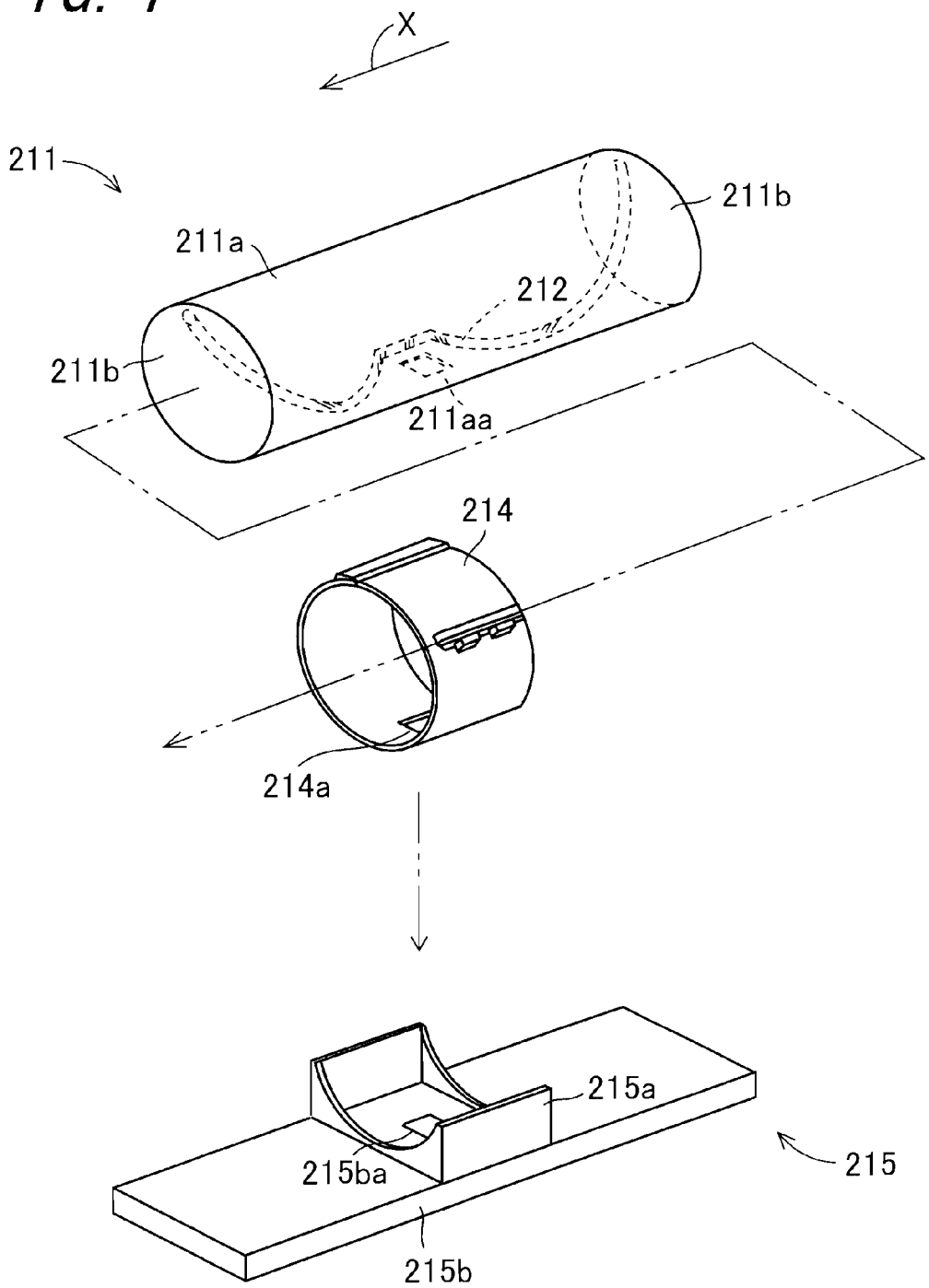
FIG. 4 is an exploded view of the supply device body section.

Next, description will be given in detail for the toner supply device 20. FIG. 2 is a view showing a configuration of the toner supply device 20, FIG. 3 is a side view of a supply device body section 21 included in the toner supply device 20, and FIG. 4 is an exploded view of the supply device body section 21.

The toner supply device 20 includes the supply device body section 21 having a toner container 211, a scraping member 212, a joining section 213, a supporting member 214, and a supporting table 215, a driving force transmitting section 22 having a drive source-side joining section 221, a rotary shaft member 222, a gear 223 and a compression spring 224, and a housing 23 having two guide members 231.

The housing 23 is a box-like member in which internal space containing the supply device body section 21, the drive source-side joining section 221, the rotary shaft member 222 and the compression spring 224 are contained is formed, and a vertically lower part thereof is opened. The gear 223 is arranged on the outside of the housing 23. In the housing 23, on a wall section 23*a* which is an end part in a predetermined direction (hereinafter, referred to as an X direction), a first through hole 23*aa* is formed, and on a wall section 23*b* which is an end part in a direction opposite to the X direction, a second through hole 23*ba* is formed. The first through hole 23*aa* is a hole in a size in which the supply device body section 21 is insertable, and an end part in the X direction of the supply device body section 21 is inserted at the time of using the toner supply device 20. The second through hole 23*ba* is a hole in which the rotary shaft member 222 is inserted, and in the second through hole 23*ba*, at the periphery of the rotary shaft member 222, a bearing (not shown) is provided.

The toner container 211 is a substantially cylindrical member in which internal space is formed, and in the internal space, toner and the scraping member 212 are contained. In the substantially cylindrical toner container 211, at a peripheral wall section 211*a*, a toner discharge port 211*aa* for discharging a toner is formed. The scraping member 212 is a member having a shape of a curved stick. The joining section 213 is fixed to the toner container 211 and has a convex part which is protruded in a direction opposite to the X direction from the toner container 211, and the convex part has a shape which is a substantially cross shape when viewed in the X direction. Description for the toner container 211 and the scraping member 212 will be described in detail below.

The supporting member 214 is a substantially cylindrical member having a diameter larger than that of the substantially cylindrical toner container 211 and supports the toner container 211 to be rotatable in a circumferential direction thereof, and is configured to be attachable/detachable to/from the supporting table 215. At the time of using the toner supply device 20, the supporting member 214 is attached to the supporting table 215. To the supporting member 214, at a vertically lower part, a first communication port 214*a* having a shape and a size which are the same as those of the toner discharge port 211*aa* is formed. The first communication port 214*a* is formed to communicate with the toner discharge port 211*aa* when the toner container 211 rotates and the toner discharge port 211*aa* is thereby positioned on a vertically lower side.

The supporting table 215 includes an attaching section 215*a* which is configured to be attachable to the supporting member 214, and a base section 215*b* having a substantially rectangular tabular shape which is fixed at a vertically lower part of the attaching section 215*a*. The base section 215*b* extends long in the X direction and in a direction opposite to the X direction, and arranged vertically above the toner hopper 13. On the base section 215*b*, a second communication port 215*ba* having a shape and a size which are the same as the first communication port 214*a* is formed. The second communication port 215*ba* is formed to communicate with the first communication port 214*a* when the supporting member 214 is attached to the supporting table 215.

The gear 223 engages with the rotary drive source included in the image forming apparatus 10 to rotate. The rotary shaft member 222 is a columnar member and is fixed to the gear 223 so as to rotate around a central axis of the column during rotation of the gear 223.

The drive source-side joining section 221 is a substantially discoid member, and has a concave part which is receded in a direction opposite to the X direction on one main face side, and the concave part has a substantially cross shape when viewed from a direction opposite to the X direction. At the time of using the toner supply device 20, the concave part fits to the convex part of the joining section 213. Another main face of the drive source-side joining section 221 is fixed to the rotary shaft member 222, and in association with the rotation of the rotary shaft member 222, the drive source-side joining section 221 also rotates.

The compression spring 224 is comprised of a coil spring, and the rotary shaft member 222 is inserted therein between the wall section 23*b* and the drive source-side joining section 221. The compression spring 224 imparts a spring force in the X direction so that the drive source-side joining section 221 separates from the wall section 23*b* without disturbing the rotation of the rotary shaft member 222 and the drive source-side joining section 221. This prevents a case where when the convex part of the joining section 213 is fitted to the concave part of the drive source-side joining section 221, the drive source-side joining section 221 is pressed by the joining section 213 to move the rotary shaft member 222 fixed to the drive source-side joining section 221 and the gear 223 fixed to the rotary shaft member 222 in a direction opposite to the X direction.

The two guide members 231 support the supply device body section 21, more specifically, the base section 215*b* of the supporting table 215 movably in the X direction. The two guide members 231 are provided by extending in the X direction from the wall section 23*b* through the first through hole 23*aa* to the outside of the housing 23.

As described above, the first through hole 23*aa* has a size to which the supply device body section 21 is insertable, and at the time of not using the toner supply device 20, the supply device body section 21 is able to be pulled out from the first through hole 23*aa* in the X direction. In the case of pulling out the supply device body section 21 from the first through hole 23*aa*, a state where the joining section 213 is fitted to the drive source-side joining section 221 is released. Then, after pulling out the supply device body section 21, it is possible that the toner container 211 and the supporting member 214 are removed from the supporting table 215 to be replaced with a new toner container 211. After replacement of the toner container 211, the supply device body section 21 is pressed therein so that the joining section 213 and the drive source-side joining section 221 are fitted one another so that the toner supply device 20 becomes usable.

With the toner supply device 20 configured as described above, the joining section 213 of the supply device body section 21 and the drive source included in the image forming apparatus 10 are joined to each other through the driving force transmitting section 22. Thereby, the substantially cylindrical toner container 211 which is fixed to the joining section 213 rotates around the central axis S. When the toner container 211 rotates and when the toner discharge port 211*aa* of the toner container 211 is positioned on the vertically lower side, the toner discharge port 211*aa*, the first communication port 214*a*, and the second communication port 215*ba* communicate with each other, and at the time, the toner contained in the toner container 211 is supplied to the toner hopper 13 through the toner discharge port 211*aa*, the first communication port 214*a*, and the second communication port 215*ba*. When the toner in the toner container 211 is used up, it is possible to pull out the supply device body section 21 in the X direction to replace the toner container 211 with a new toner container 211.

Figure 5:
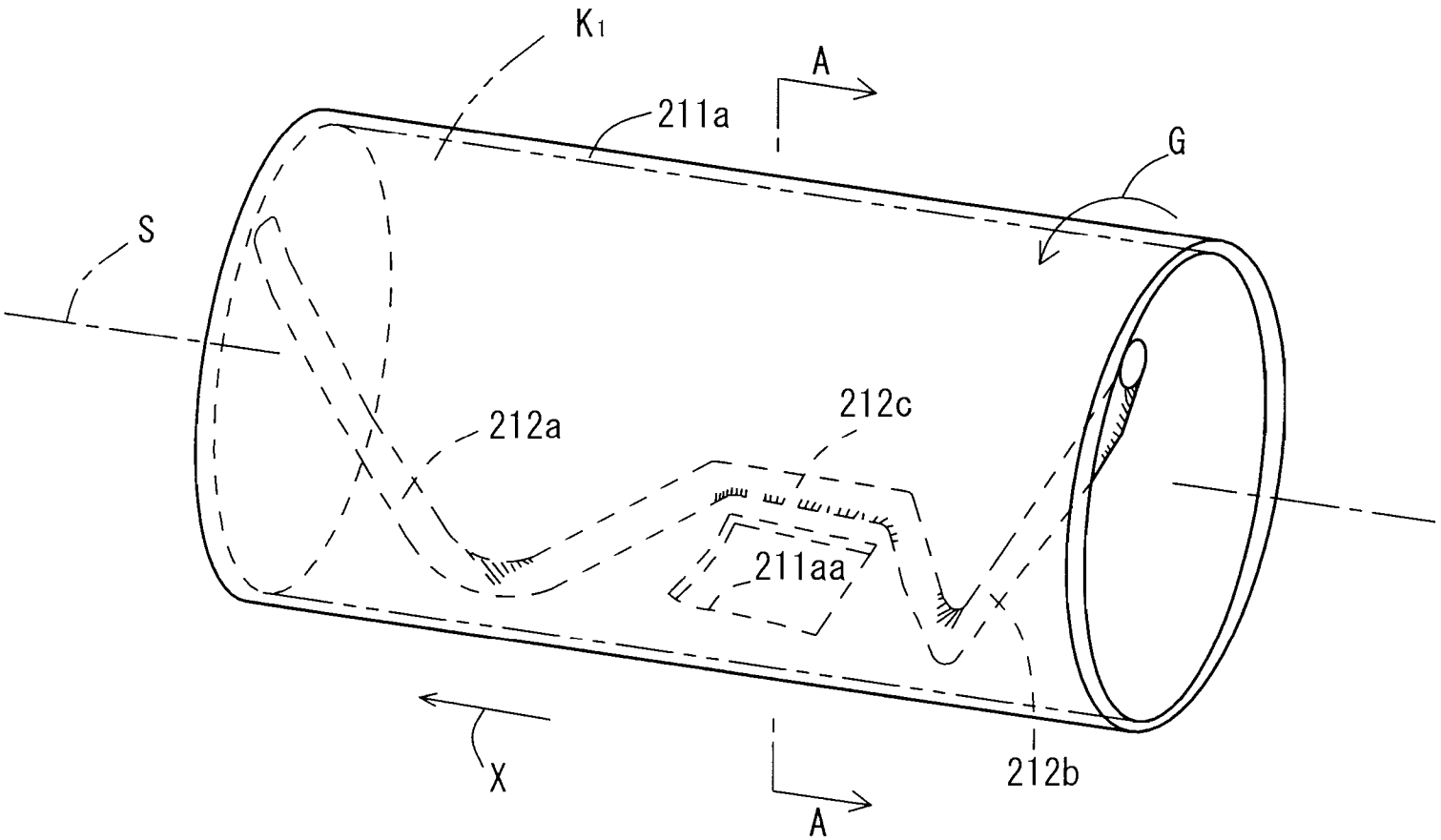
FIG. 5 is a perspective view of a peripheral wall section and a scraping member of a toner container.
Figure 6:
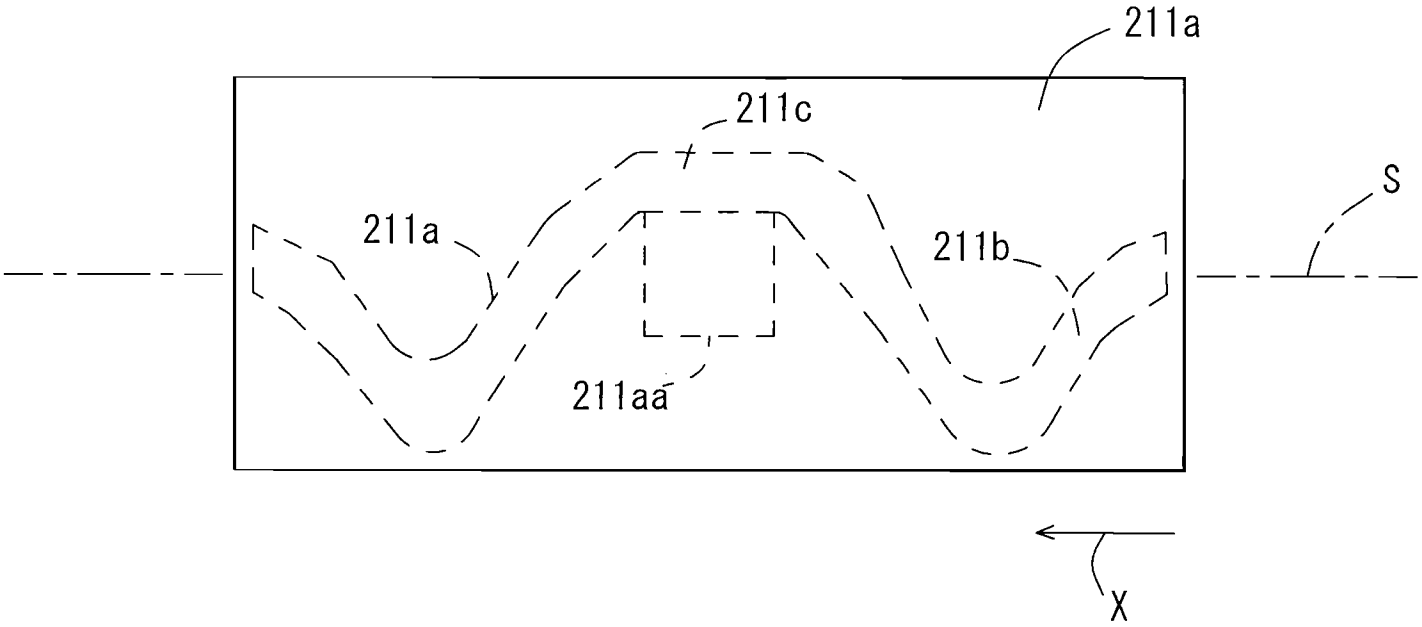
FIG. 6 is a view of the peripheral wall section and the scraping member when planarly viewed in a direction perpendicular to a central axis S.
Figure 7:
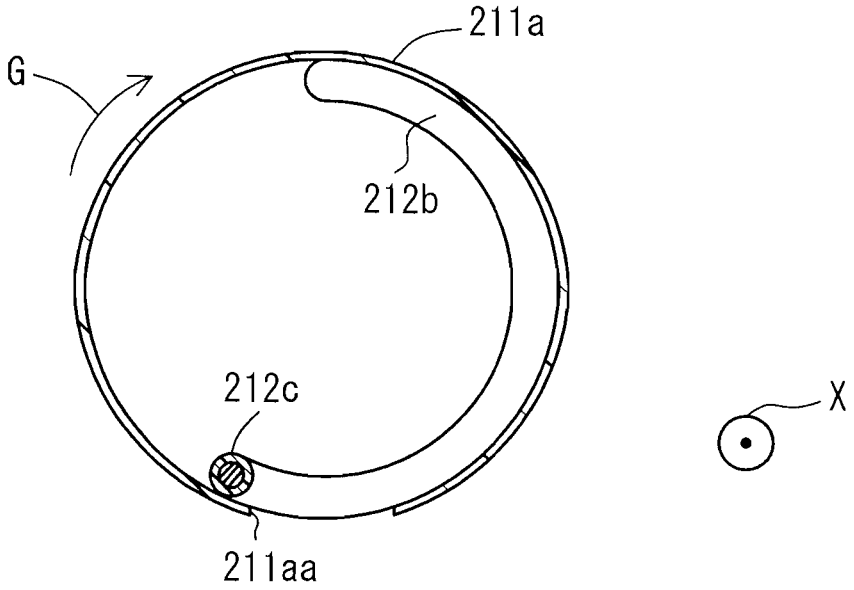
FIG. 7 is a cross sectional view of the peripheral wall section and the scraping member taken along the line A-A shown in FIG. 5.

Next, description will be given in detail for the toner container 211 and the scraping member 212. FIG. 5 is a perspective view of the peripheral wall section 211*a* and the scraping member 212 of the toner container 211. FIG. 6 is a view of the peripheral wall section 211*a* and the scraping member 212 when planarly viewed in a direction perpendicular to the central axis S and when planarly viewed so as to have a maximum area of the toner discharge port 211*aa*. FIG. 7 is a cross sectional view of the peripheral wall section 211*a* and the scraping member 212 taken along line A-A shown in FIG. 5.

The toner container 211 includes the peripheral wall 211*a* and the two bottom wall sections 211*b* shown in FIG. 4. The peripheral wall section 211*a* is a member which contacts with a side face of an imaginary column (hereinafter, referred to as "imaginary column $K_1$"), and surrounds the side face along the side face. In the embodiment, the peripheral wall section 211*a* is a member in a shape having an inner diameter of 50 mm to 150 mm which is equivalent to a diameter of the imaginary column $K_1$ and, an outer diameter of 52 mm to 154 mm, and an opening formed in the center of the peripheral wall section of the cylinder extending in the X direction and the direction opposite to the X direction. When the peripheral wall section 211*a* is planarly viewed in a direction perpendicular to the central axis S of the imaginary column $K_1$ so as to have a maximum area of the toner discharge port 211*aa*, that is, planarly viewed as in FIG. 6, the toner discharge port 211*aa* which is an opening has a square shape, and a length of one side of the square shape is 10 mm to 25 mm. Further, a length of the peripheral wall section 211*a* in the central axis S direction of the imaginary column $K_1$ is 400 mm to 600 mm.

As shown in FIG. 4, the bottom wall sections 211*b* are fixed to an end part in the X direction and an end part in a direction opposite to the X direction, respectively. Each bottom wall section 211*b* is a discoid member having a diameter of 50 mm to 150 mm, and a central axis of the disk, the central axis S of the imaginary column $K_1$, and a central axis of the rotary shaft member 222 correspond with one another. The toner container 211 rotates in a rotational direction G around the central axis S of the imaginary column $K_1$ at 5 rpm to 15 rpm by a rotary drive source (not shown) included in the image forming apparatus 10.

The two bottom wall sections 211*b* and the peripheral wall section 211*a* are formed of a material such as, polyethylene, polypropylene, a HIPS resin (high-impact polystyrene resin), an ABS resin (acrylonitrile-butadiene-styrene copolymer synthetic resin) and the like. In space surrounded by the two bottom wall sections 211*b* and the peripheral wall section 211*a*, toner is contained. Further, in the space, the scraping member 212 is contained so as to freely rotate around the central axis S of the imaginary column $K_1$.

The scraping member 212 is a member for scraping off toner adhering to the peripheral wall section 211*a*. More specifically, the scraping member 212 is provided to disintegrate the toner which strongly adheres to the peripheral wall section 211*a* to rotate with the peripheral wall section 211*a* so as to make the toner usable when there is a small amount of toner in the toner container 211.

In the embodiment, the scraping member 212 includes a first curved part 212*a*, a second curved part 212*b*, and a connecting part 212*c*. The first curved part 212*a* is a member of a shape extending so as to follow a portion of a half cycle or more and one cycle or less of a first spiral on the side face of the imaginary column $K_1$. The second curved part 212*b* is a member of a shape extending so as to follow a portion of a half cycle or more and one cycle or less of a second spiral on the side face of the imaginary column $K_1$, the second spiral having a proceeding direction opposite to that of the first spiral on the side face of the imaginary column $K_1$. The connecting part 212*c* is a substantially columnar member connecting the first curved part 212*a* and the second curved part 212*b*, and extending along a line segment which is parallel to the central axis S on the side face of the imaginary column $K_1$. The first curved part 212*a* and the second curved part 212*b* extend in a direction opposite to the rotational direction G in a circumferential direction of the imaginary column $K_1$ while being in internal contact with the side face of the imaginary column $K_1$. Further, the first curved part 212*a* and the second curved part 212*b* are respectively extended from the connecting part 212*c* so as to be separated from one another in the central axis S direction.

In the embodiment, the "spiral" is a consecutive space curve on the side face of the imaginary column $K_1$, and a space curve that proceeds in one direction among the central axial directions S of the imaginary column $K_1$, while proceeding in one direction among the circumferential directions of the imaginary column $K_1$. In the case of viewing in one direction among the central axial directions S of the imaginary column $K_1$, the spiral is, while proceeding in the one direction among the central axis S directions of the imaginary column $K_1$, and proceeding in a right-handed direction in the circumferential directions of the imaginary column $K_1$, referred to as being a right-handed spiral, and referred to as being as a left-handed spiral when proceeding in a left-handed direction. The right-handed spiral and the left-handed spiral proceed in directions opposite from each other.

Among the spirals, a spiral which spirals around the side face of the imaginary column $K_1$ for i (i>0) cycle in a circumferential direction is referred to as "i cyclic spiral". For example, a spiral which spirals just half around the side face of the imaginary column $K_1$ in a circumferential direction is a half cyclic spiral, and a spiral which spirals just around the side face of the imaginary column $K_1$ in a circumferential direction is one cyclic spiral.

Further, among the spirals, a spiral with a lead angle that is constant in all points on the spiral is especially referred to as a "constant spiral". Here, an angle formed of a tangent line of the spiral at a certain point on the spiral and a straight line that is made by projecting the tangent line to a vertical plane with respect to the central axial S direction of the imaginary column $K_1$ surrounded by the spiral is a "lead angle" at the point. The lead angle is an angle that is larger than 0° and smaller than 90°.

In the embodiment, the first curved part 212*a* is a solid formed by a trajectory of one circle $J_1$ which is in internal contact with the side face of the imaginary column $K_1$ and perpendicular to the central axis S of the imaginary column $K_1$, when the circle $J_1$ is moved along a right-handed general spiral $C_1$ on the side face of the imaginary column $K_1$ (hereinafter, leading angle is referred to as $\theta_1$) in one direction $D_1$ among the central axis S directions of the imaginary column $K_1$.

Figure 8A:
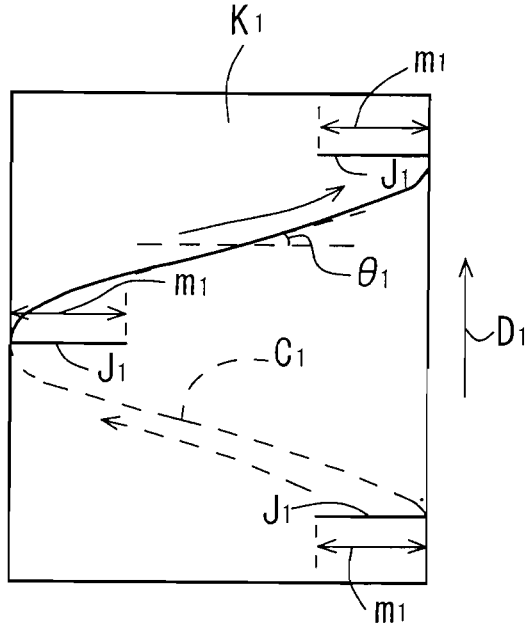
FIGS. 8A and 8B are views for explaining an example of a first curved part.
Figure 8B:
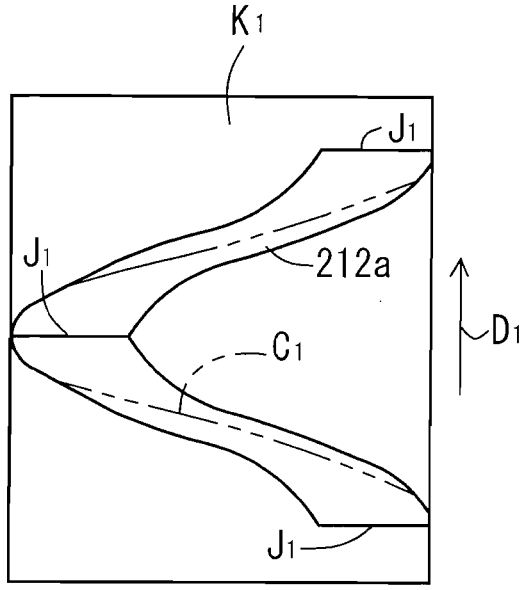

In FIGS. 8A and 8B, as an example of the first curved part 212*a*, the first curved part 212*a* is shown when the circle is moved along a right-handed one cyclic general spiral. FIG. 8A shows a side face of the imaginary column $K_1$, a right-handed general spiral $C_1$ on the side face of the imaginary column $K_1$, and a start position and a finish position of the circle $J_1$ which moves in the one direction $D_1$ along the general spiral $C_1$. The circle $J_1$ which is shown on the lowermost side in FIG. 8A shows the start position at the time of movement, and the circle $J_1$ which is shown on the uppermost side shows the finish position. When the circle $J_1$ is moved in the one direction $D_1$ along the general spiral $C_1$ as shown in FIG. 8A, a trajectory of the circle $J_1$ becomes a solid formed by an external shape of the first curved part 212*a* along the right-handed one cyclic general spiral $C_1$.

With respect to the first curved part 212*a*, a lead angle $\theta_1$ is settable as appropriate within a range of 20° or more and 70° or less. Moreover, a diameter $m_1$ of the circle $J_1$ is settable as appropriate within a range of 5 mm or more and 15 mm or less.

In the embodiment, a shape of the second curved part 212*b* is the same as that of the first curved part 212*a* except that the proceeding direction of the spiral is the opposite. That is, the second curved part 212*b* has a shape along a left-handed general spiral and it is possible to set as appropriate the lead angle $\theta_1$ within a range of 20° or more and 70° or less, and set as appropriate a diameter $m_1$ of the circle $J_1$, for example, within a range of 5 mm or more and 15 mm or less.

As shown in FIG. 6, in the central axis S direction of the imaginary column $K_1$, a length of the scraping member 212 is set to be the same as that of the peripheral wall section 211*a*, or about 0 mm to 5 mm shorter than that. Further, in the central axis S direction of the imaginary column $K_1$, the lengths of the first curved part 212*a* and the second curved part 212*b* are set to be the same and a length of the connecting part 212*c* is set to be same as that of one side of the toner discharge port 211*aa* or about 1 mm to 5 mm longer than that. Then, the connecting part 212*c* is opposite to the toner discharge port 211*aa*. More specifically, a central point of the connecting part 212*c* in the central axis S direction of the imaginary column $K_1$ is positioned within a range in which the toner discharge port 211*aa* is formed.

Each of the first curved part 212*a*, the second curved part 212*b*, and the connecting part 212*c* is configured so that specific gravity becomes 1 to 3. More preferably, each of the first curved part 212*a*, the second curved part 212*b*, and the connecting part 212*c* is a member having uniform weight, and the specific gravity of each of the first curved part 212*a*, the second curved part 212*b*, and the connecting part 212*c* is set to be larger than the specific gravity of the toner. For example, when a main component of the toner is polyester, the specific gravity of the toner is about 1.05, and the specific gravity of each of these members is set to larger than the value. Moreover, the first curved part 212*a*, the second curved part 212*b*, and the connecting part 212*c* are formed of a material having high rigidity for scraping off the toner surely.

For example, the first curved part 212*a*, the second curved part 212*b*, and the connecting part 212*c* may be formed of aluminum (specific gravity: 2.7), a HIPS resin (specific gravity: 1.0), an ABS resin (specific gravity: 1.1) or the like, or may be formed by coating with a coating resin a core material formed of SUS 304 (specific gravity: 7.9), iron (specific gravity: 7.8) and the like. As the coating resin, for example, materials such as polyethylene, polypropylene, a HIPS resin, an ABS resin or the like may be used.

In a state where the toner container 211 is not rotated and there is no toner in the toner container 211, while a central point of the toner discharge port 211*aa* is positioned on the vertically lowermost side, when the scraping member 212 is at a position which is stable in gravity, that is, when a gravity center of the scraping member 212 is positioned on the vertically lowermost side, it is preferable that a position of the connecting part 212*c* is at a position along a downstream end in the rotational direction G of the toner discharge port 211*aa*. For example, a position of the gravity center of the scraping member 212 is able to be adjusted so that a weight of the connecting part 212*c* is brought into one to two times a total weight of the first curved part 212*a* and the second curved part 212*b*, and thereby the position of the connecting part 212*c* becomes the position described above. In adjusting the position of the gravity center of the scraping member 212, the first curved part 212*a*, the second curved part 212*b*, and the connecting part 212*c* are composed of the core material made of metal and the coating resin as described above, and a size of each core material and a thickness of each coating resin are adjusted as appropriate, thereby making it possible to adjust the weight of each of the scraping member 212, the first curved part 212*a*, and the second curved part 212*b*, while keeping an external shape of each member of them.

In this way, the toner container 211 has the scraping member 212 including the first curved part 212*a*, the second curved part 212*b*, and the connecting part 212*c*, provided inside thereof. The scraping member 212 is contained in the toner container 211 so as to freely rotate around the central axis S, and moves with toner in association with a rotation of the toner container 211 when there is a large amount of toner remaining in the toner container 212, thus there is not so heavy load imposed on the toner. When a large amount of toner is discharged from the toner discharge port 211*aa* and there is a small amount of toner in the toner container 212, the scraping member 212 at a gravitationally stable position moves less and comes to oscillate slightly. The toner container 211 rotates around the central axis S relative to the scraping member 212 with less movement, and the toner strongly adhering to the circumferential wall 211*a* of the toner container 211 also rotates, thus a relative speed of the scraping member 212 with the toner adhering to the peripheral wall section 211*a* becomes high. The scraping member 212 collides with the toner adhering to the peripheral wall section 211*a* in a state where the relative speed is high, so that the toner adhering to the peripheral wall section 211*a* to be agglomerated is shaved and disintegrated to become fine by the scraping member 212 and the fluidity thereof are recovered, and thus easily to be discharged from the toner container 211.

For example, relative to the rotating toner container 211, the scraping member 212 oscillates in a vicinity of a gravitationally stable position. The toner agglomerate adhering to the peripheral wall section 211*a* collides with the scraping member 212 from an upstream side in the rotational direction G, and as the result, disintegrated or shaved a little continues to adhere to the peripheral wall section 211*a*. In the case of continuing to adhere to the peripheral wall section 211*a*, the toner agglomerate holds up the scraping member 212 to the vertically upper side along inside of the peripheral wall section 211*a*. The scraping member 212 which is held up presses the toner agglomerate to a vertically lower side along inside of the peripheral wall section 211*a*, and the toner agglomerate is thus disintegrated, or shaved a little to continue to adhere to the peripheral wall section 211*a*. The scraping member 212 moves, in the case of being held up to a certain degree in the vicinity of the gravitationally stable position with self weight along the inside of the peripheral wall section 211*a* in the rotational direction G, is separated from the toner agglomerate. The toner agglomerate collides with the separated scraping member 212 again from the upstream side of the rotational direction. By repeating such movement, the toner agglomerate thus becomes finer gradually, and is scraped off by the scraping member 212.

In this manner, the scraping member 212 which is contained in the toner container 211 so as to freely rotate is able to scrape off the toner adhering to the peripheral wall section 211*a* of the toner container 211 while suppressing a load imposed on the toner to be lessened. Further, the scraping member 212 has the first curved part 212*a* and the second curved part 212*b* extending so as to follow the portion of a half cycle or more of a spiral on the side face of the imaginary column $K_1$. Therefore, even when the scraping member 212 rotates around the central axis S in any way when there is a large amount of toner remaining in the toner container 212, a state of located along the peripheral wall section 211*a* of the toner container 211 is maintained. Whereas, for example, in the case of a scraping member in a blade shape which has a sharp-pointed section and a flat section, and scrapes off toner by the sharp-pointed section brought into contact with the peripheral wall section 211*a*, when there is a large amount of toner remaining in the toner container 212, there is a possibility of becoming a state where the scraping member is pressed by the toner to be moved so that the sharp-pointed section of the blade is separated from the peripheral wall section 211*a* and the flat portion of the blade is brought into contact with the peripheral wall section 211*a*. In the case of becoming such a state, the scraping member is not able to scrape off the toner.

The scraping member 212 according to the embodiment is able to maintain the state of located along the peripheral wall section 211*a* of the toner container 211 as described above, it is thus possible to scrape off the toner more surely. As described above, the toner supply device 20 provided with the scraping member 212 is able to reduce as much as possible the toner remains in the toner container 211 while suppressing a load imposed on the toner to be lessened.

In the present embodiment, the scraping member 212 includes the first curved part 212*a* extending so as to follow a portion of a half cycle or more and one cycle or less of the first spiral on the surface of the imaginary column $K_1$, the second curved part 212*b* which is extended so as to follow a portion of a half cycle or more and one cycle or less of the second spiral on the side face of the imaginary column $K_1$, and the connecting part 212*c* connecting the first curved part 212*a* and the second curved part 212*b*. Since the first spiral and the second spiral proceed in opposite directions from each other, in a circumferential direction of the imaginary column $K_1$, a direction toward an end part connected to the connecting part 212*c* from an end part not connected thereto in the first curved part 212*a* corresponds with a direction toward an end part connected to the connecting part from an end part not connected thereto in the second curved part 212*b*. The toner container 211 rotates in the rotational direction G which corresponds to the direction so that the toner scraped off by the scraping member 212 moves along the first curved part 212*a* and the second curved part 212*b* to move to the connecting part 212*c*. The connecting part 212*c* is opposite to the toner discharge port 211*aa*, and the toner going to the connecting part 212*c* is thus discharged from the toner discharge port 211*aa*.

In this manner, it is possible to guide toner to the toner discharge port 211*aa* by the scraping member 212. Accordingly, there is no need to set a rib in a spiral shape for conveying the toner to the peripheral wall section 211*a*. Note that, the reason why the first curved part 212*a* and the second curved part 212*b* are formed into a shape along a portion of one cycle or less of the spiral is that when the first curved part 212*a* and the second curved part 212*b* become too long in the circumferential direction of the imaginary column $K_1$, it becomes difficult to guide the toner.

As another embodiment, a spiral rib may be provided on the peripheral wall section 211*a* within a range of not disturbing the free rotation of the scraping member 212. Furthermore, as another embodiment, on the peripheral wall section 211*a*, the toner discharge port 211*aa* may be formed at an end part in the central axis S direction, and the scraping member 212 may be one in which either one of the first curved part 212*a* and the second curved part 212*b* is not provided.

Further, in the embodiment, each of the first and second curved parts 212*a* and 212*b* has a circular cross-section perpendicular to the central axis S direction. Accordingly, when the first and second curved parts 212*a* and 212*b* collide with the toner adhering to the peripheral wall section 211*a* of the toner container 211, it does not occur that the first and second curved parts 212*a* and 212*b* stick in the toner agglomerate so that the first and second curved parts 212*a* and 212*b* continue to rotate with the toner. Therefore, the scraping member 212 is able to scrape off the toner more surely. Moreover, each of the first and second curved parts 212*a* and 212*b* has a cross-section in a circular shape, and it is thus possible to suppress accumulation of the toner which is not adhering to the peripheral wall section 211*a* on the scraping member 212. Note that, as another embodiment, a cross-section of each of the first and second curved parts 212*a* and 212*b* may have any shape, and, for example, a polygonal shape.

In the embodiment, the scraping member 212 is configured to have specific gravity larger than that of the toner and to be harder than the toner. Therefore, it is possible to disintegrate the toner agglomerate more finely when the scraping member 212 collides with the toner adhering to the peripheral wall section 211*a* of the toner container 211. Moreover, when the specific gravity of the scraping member 212 is larger than the specific gravity of the toner, a buoyant force generated to the scraping member 212 when there is a large amount of toner remaining in the toner container 212 becomes smaller than a self weight of the scraping member 212, so that it is possible to maintain the state where the scraping member 212 is along the peripheral wall section 211*a* of the toner container 211 more surely. Thereby, the scraping member 212 is able to scrape off the toner more surely.

As described above, the image forming apparatus 10 includes the toner supply device 20 which reduces as much as possible toner remaining in the toner container 211 while suppressing a load imposed on the toner to be lessened. Therefore, it is possible to use toner without wasting it while it is possible to form a high definition image since there will be less deterioration in toner supplied to the developing device 47.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A toner supply device, comprising:

a toner container having a wall section which is cylindrically shaped and has an opening formed therein, the toner container containing toner in a space surrounded by the wall section;

a joining section fixed to the toner container, configured to join a rotary drive source which rotates the toner container around an axis of the wall section; and a scraping member which is contained in the space so as to freely rotate around the axis of the wall section and which scrapes off toner adhering to the wall section, the scraping member comprising:

a first curved part extending along a portion of a half cycle or more and one cycle or less of a first spiral along an inner face of the wall section, a second curved part extending along a portion of a half cycle or more and one cycle or less of a second spiral along the inner face of the wall section, wherein a proceeding direction of the second curved part is opposite to that of the first curved part, and a connecting part which connects the first curved part and the second curved part, which extends along a line segment which is parallel to the axis of the wall section, and which is opposite to the opening.

2. The toner supply device of claim 1, wherein the scraping member has a circular cross-section perpendicular to a direction in which the axis of the wall section extends.

3. The toner supply device of claim 1, wherein the scraping member has specific gravity with respect to water larger than that of the toner.

4. The toner supply device of claim, wherein each of the first curved part, the second curved part, and the connecting part is configured so that they have a specific gravity with respect to water of 1 to 3.

5. The toner supply device of claim 1, wherein each of the first curved part, the second curved part, and the connecting part is a member having uniform weight, and wherein the specific gravity with respect to water of each of the first curved part, the second curved part, and the connecting part is set to be larger than the specific gravity with respect to water of the toner.

6. An electrophotographic image forming apparatus, comprising:

a developing device; and the toner supply device of claim 1 which supplies toner to the developing device.

* * * * *